United States Patent [19]

Schmidt

[11] 4,295,533

[45] Oct. 20, 1981

[54] PNEUMATICALLY OPERATED RAM BORER

[76] Inventor: Paul Schmidt, P.O.B. 20, 5940 Lennestadt/Saalhausen, Fed. Rep. of Germany

[21] Appl. No.: 129,835

[22] Filed: Mar. 13, 1980

[30] Foreign Application Priority Data

Mar. 26, 1979 [DE] Fed. Rep. of Germany ..... 2911837

[51] Int. Cl.[3] ..... E21B 11/02

[52] U.S. Cl. ..... 175/19; 91/19; 91/20; 175/103; 173/91

[58] Field of Search ..... 91/19, 20, 234; 173/91; 175/19, 103

[56] References Cited

U.S. PATENT DOCUMENTS

| | | | |
|---|---|---|---|
| 998,477 | 7/1911 | Duvall et al. | 91/20 |
| 1,965,064 | 7/1938 | Zwayer | 91/277 |
| 3,651,879 | 3/1972 | Sudnishnikov et al. | 175/19 |
| 3,756,328 | 9/1973 | Sudnishnikov | 175/19 |
| 4,114,700 | 9/1978 | Tkach et al. | 91/19 |

*Primary Examiner*—William F. Pate, III

*Attorney, Agent, or Firm*—Toren, McGeady & Stanger

[57] ABSTRACT

A self-driven pneumatically operated ram borer for boring holes in the ground includes a casing containing a percussion piston and a control sleeve for controlling the supply of compressed air through a hose to cause the piston to reciprocate, is provided with a control tube which is rotatable to vary the porting of the borer to cause it to move either forwards or rearwards. The tube is rotated into either a forward position or a reverse position by means of a flexible shaft which extends from the casing within the hose. By enclosing the shaft within the hose, the shaft is protected and is not subject to friction against the wall of the hole bored by the borer or to jamming if the hole collapses. The borer can thus easily be controlled even when it has passed through a very long bore hole.

7 Claims, 5 Drawing Figures

PNEUMATICALLY OPERATED RAM BORER

This invention relates to self-driven pneumatically operated ram borers for boring holes in the ground, the borers being of the kind comprising a tubular casing, a percussion piston which is axially slidable to and fro in the casing, a control sleeve or tube which controls the to and fro motion of the piston by opening and closing control ports in the percussion piston, and control means for moving the control sleeve or tube between a first position in which the piston is caused to move so that it drives the borer forwards and a second position in which the piston is caused to move so that it drives the borer rearwardly.

Ram borer controls comprising a rotatable control tube in a stationary sleeve are disclosed in German Offenlegungsschrift No. 26 34 066. The control described in German Offenlegungsschrift No. 26 34 066 has a stationary control sleeve, in which there is a rotatable but axially fixed control tube. The control tube and a compressed air hose are non-rotationally connected together, so that by twisting the compressed air hose a changing-over from forward to rearward movement of the borer and vice versa is possible.

The advantages of this rotary mechanical change-over lie in the fact that the change from forward to rearward motion and vice versa is completely independent of the compressed air supply and that from the angular position of the compressed air hose, which does not change even when the ram borer is stopped and started up again, a clear indication is provided of the direction of operation of the ram borer. With this arrangement, however, it has been found that with fairly long ground bore holes having lengths, for example, of more than 100 m, changing-over by twisting the compressed air hose can lead to difficulties if the compressed air hose, when horizontal or almost horizontal bores are being formed, rests against the bottom of the wall of the bore hole and the friction acting on the hose increases drastically with increasing length of bore hole. It can also happen that the bore hole produced by means of the ram borer collapses and this leads to additional friction of the hose in the bore hole. The friction can, in certain circumstances, become so large that the compressed air hose simply cannot any longer be rotated, and thus changing-over is no longer possible. In these circumstances it may be impossible to extract the borer from the hole.

A need furthermore exists, especially when starting up a ram borer and when operating in soft ground, for driving the ram borer with a reduced driving power. One way of achieving this consists in throttling the compressed air supply from a compressor by means of a shut-off valve. Since, however, these shut-off valves in general do not act very well as throttles for regulating the compressed air supply, the possibilities of adjustment are extremely inaccurate.

Other change-over controls, some operating mechanically and some pneumatically, are disclosed in German Patent Specification No. 1,634,417 and German Offenlegungsschrift No. 2,105,229. They all incorporate an adjustable tube or sleeve, the position of which with respect to radial control ports in the percussion piston or in a control sleeve which extends into a working chamber of the percussion piston determines the direction of movement of the ram borer. In all these cases, a mechanically or pneumatically induced movement of a control tube or sleeve with or without control ports is necessary, and consequently the aforementioned difficulties arise.

The object of the present invention therefore is so to improve the control of a ram borer of the kind described above that the borer can be changed over between forward and reverse movement in a simple manner even with very large bore hole lengths, without the risk of this being hindered by soil friction or by parts of the bore hole having fallen in. Also, the additional possibility is preferably provided by a preferred construction in accordance with the invention of infinitely adjusting the driving power of the ram borer quite independently of the pressure of the compressed air supplied to it.

To this end according to this invention, in a ram borer of the kind described above, the control means comprises a flexible actuating connection which is connected to the control sleeve or tube and extends from the casing inside the hose.

The connection can be comparatively thin, so that the free cross-section in the compressed air hose in all cases is sufficient for supplying the necessary amount of compressed air to the ram borer.

Preferably there is a control tube which has control ports and extends into a working chamber in the percussion piston, the control tube being rotatable between the first and second positions and the actuating member being a torsionally stiff shaft.

In comparison with a compressed air hose, a flexible shaft may be considerably torsionally more stiff, so that even with fairly large bore hole lengths the angular position of the control tube agrees with the angular position of the remote end of the flexible shaft. The friction between the internal wall of the compressed air hose and the flexible shaft is slight and is not influenced by the nature of the ground bore produced by means of the ram borer. By means of a flexible shaft controlling a control tube which has control ports and is rotatable in a fixed control sleeve having control openings through its wall, the driving output of the ram borer can be infinitely adjusted in a simple manner, since, by means of the flexible shaft, intermediate positions of the control tube in relation to the control sleeve can be set. In these intermediate positions, the control ports and the openings register with one another only partially and in this way a throttled passage of the compressed air can be achieved.

Similar intermediate positions can also be achieved with an axially movable control sleeve or an axially adjustable control tube in a stationary control sleeve.

The rotation of the flexible shaft is with advantage effected by an adjusting lever which is mounted on the end of the shaft remote from the control tube and stops are provided for limiting the angle of swing of the adjusting lever, the stops being mounted on a pipe elbow on the hose.

When the hose has a pipe elbow, the elbow may have a laterally directed pipe coupling and a passage co-axial with the hose, the actuating connection passing through the passage and being sealed therein to prevent the escape of compressed air but allow movement of the connection.

The pipe elbow enables the flexible shaft or other connection to be conducted straight out from the hose and to be operated between the stops by means of the adjusting lever. During adjustment, intermediate positions are possible and a central position between the two stops may effect stopping of the ram borer.

The pipe elbow may be connected directly by means of the laterally directed coupling to a compressor, or a further length of hose, connected to a remote compressor, may be connected to the pipe elbow. In either case, the length of hose with the pipe elbow must be sufficiently long for the pipe elbow always to remain outside the bore hole produced by means of the ram borer.

In order to drive particularly long bore holes, which are longer than the usual lengths of hose, a number of lengths of hose can be coupled to one another. In this case, a flexible shaft in sections corresponding in length to the lengths of hose may be used. The shaft sections have at their end torsion transmitting detachable couplings. These couplings may with advantage be formed as bayonet couplings, which are engaged with each other before the lengths of hose are coupled together. In this way, very long lengths of bore hole can be produced without difficulty by means of the ram borer, and the ram borer is easy to change over from forward to reverse motion.

Another alternative construction consists in the control tube being rotatable within a fixed sleeve which has openings through its wall. In this case, the control ports in the tube are brought, as the tube is rotated by means of the shaft, into register with the control openings of the percussion piston, when the direction of movement of the borer is to be changed.

A sleeve or tube having no control ports or openings can, however, also extend axially displaceably into the chamber of the percussion piston and be connected to the actuating connection. The changing-over from forward to reverse movement of the ram borer is in this case effected by a movement of the sleeve or tube in a direction opposite to the direction of movement of the borer as a result of which the period during which compressed air is supplied to a space in front of the percussion piston is lengthened. Consequently, the percussion piston, at the end of its rearward stroke strikes an abutment in the casing and thereby imparts to the casing an impulse towards the rear.

Because the actuating connection extends inside the compressed air hose, it does not come into contact with the soil. The actuating connection is thus protected from damage and other adverse influences.

An example of a ram borer in accordance with the invention is illustrated in the accompanying drawings in which.

Figure 1:
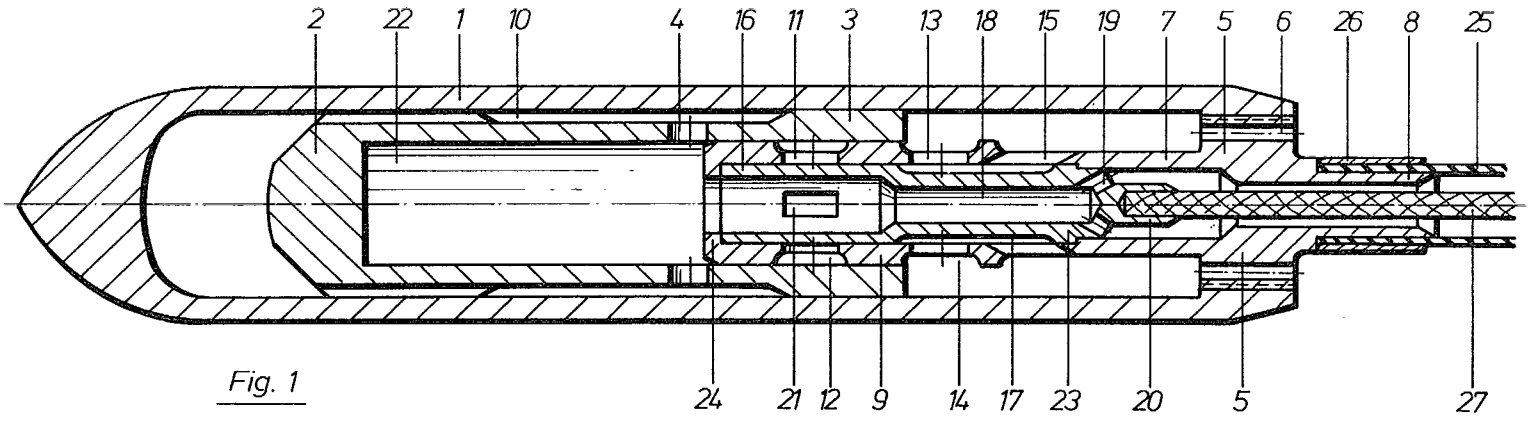
FIG. 1 is a longitudinal section through the ram borer with the control set to cause the ram borer to make forward motion.

The ram borer has a casing 1, in which a percussion piston 2 is axially slidable with an annular space 10 around part of the piston. At its rearward end, the percussion piston 2 has a peripheral wall 3 with radial control ports 4. At the rear end of the casing 1 there is an insert ring 5 with axial vent bores 6 leading to atmosphere. The ring 5 has a tubular extension 7, to which a control sleeve 9 is attached. In the control sleeve 9 there are openings 11 which lead into an annular groove 12, so that independently of the angular position of the control ports 4 in the wall 3 in relation to the openings 11, there is always communication between the control ports 4 and the openings 11. In the control sleeve 9 there are further openings 13, which in FIG. 1 are in communication, via longitudinal grooves 17 of a rotatable but axially fixed control tube 16, with openings 15. The openings 13 are also disposed in an annular groove 14 of the control sleeve 9, while the openings 15 are situated in a region of the tubular extension 7 of smaller external diameter than the control sleeve 9.

Figure 2:
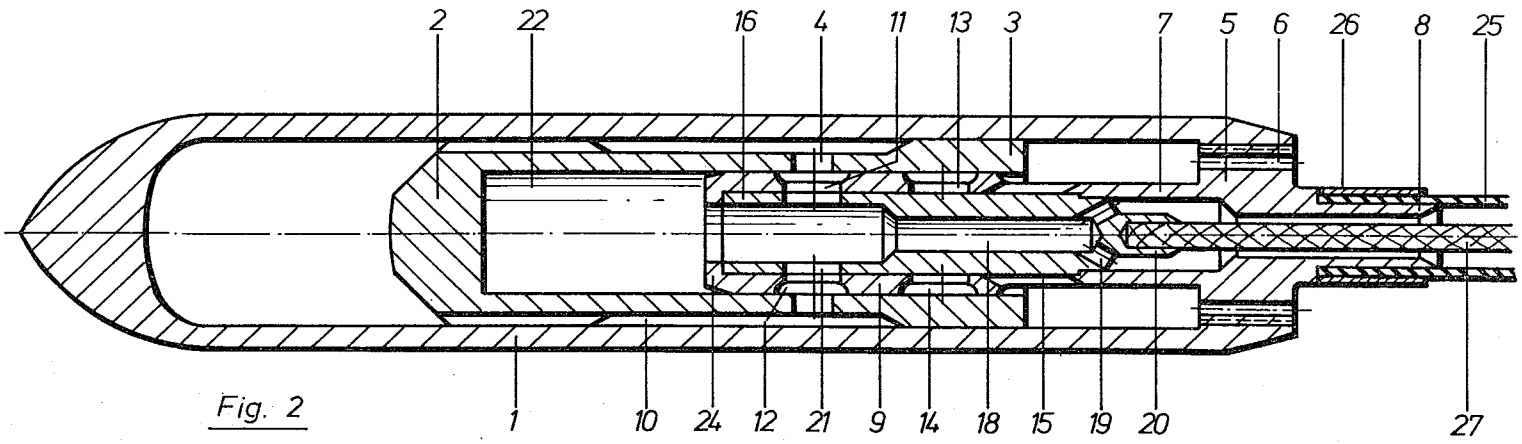
FIG. 2 is a section corresponding to FIG. 1, but with the control set in the rearward motion position.
Figure 4:
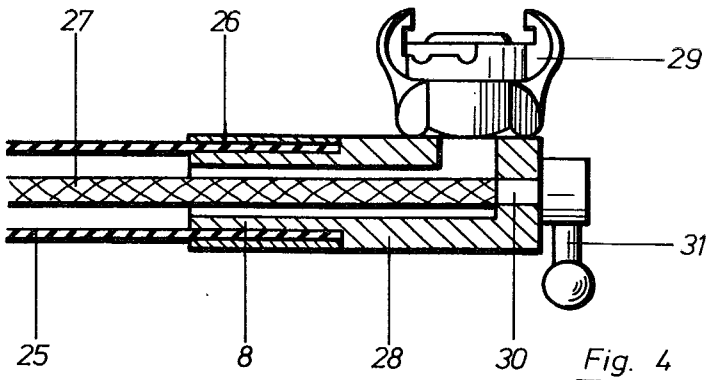
FIG. 4 is a longitudinal section through a hose end piece with the adjusting lever.

In the control tube 16 there are control ports 21, which can be brought into register with the openings 11 in the control sleeve 9 and are shown in this position in FIG. 2. The control tube 16 has an open-fronted longitudinal bore 18, leading into a working chamber 22 of the percussion piston 2. In the region of the control ports 21, the diameter of the longitudinal bore 18 is greater than in the region of the longitudinal grooves 17. From the rear end of the longitudinal bore 18, oblique bores 19 lead out, forming a connection between the longitudinal bore 18 and the interior of the tubular extension 7.

The control tube 16 terminates at its rear end in a cylindrical projection 20 having a blind bore, in which the end of a flexible shaft 27 is fixed. The control tube 16 is mounted so that it is fixed in its axial position by a projection 23 on the tubular extension 7 and a shoulder 24 on the control sleeve 9, but is rotatable. Outside the casing 1, the tubular extension 7 has a nipple 8, on to which a compressed air hose 25 is pushed and is secured by means of a crimped sleeve 26.

The hose 25 and the flexible shaft 27 extend from the rear of the casing 1 as far as a pipe elbow 28 with a nipple 8, on to which the compressed air hose 25 is pushed and is secured by means of a crimped sleeve 26. Projecting laterally on the pipe elbow 28 there is a hose coupling 29, by means of which a further length of hose can be attached or a direct connection can be made to a compressor. In an axial continuation of the compressed air hose 25, there is a sealed passage 30 in the elbow 28. The shaft 27 extends through the passage 30 and the passage permits the rotation of the flexible shaft 27 but does not allow any escape of compressed air. Two stops 32, mounted on the outer surface of the pipe elbow 28, limit the angular swing of an adjusting lever 31, connected in a torsionally stiff manner to the flexible shaft 27 and hence limit rotation of the shaft 27 and the tube 16.

In order, where there are large lengths of bore hole, to enable both the compressed air hose 25 and the flexible shaft 27 to be extended as desired, torsionally stiff but detachable couplings are disposed at the ends of the flexible shaft 27 in the region of the usual hose couplings. These shaft couplings are constructed as bayonet connections and consist at one shaft end of a coupling sleeve 33 with slots 35 and at the other shaft end of a coupling journal 34 with pins 36. The couplings halves 33, 34 are pushed together in the usual way and engage in such a way that a transmission of torque is possible from the end of one shaft section to the end of the next shaft section.

In the forward motion position of the control tube 16 shown in FIG. 1, compressed air passes via the oblique bores 19 and the longitudinal bore 18 into the working chamber 22. At the same time, compressed air passes via the control ports 4 and the annular space 10 in front of the front face of the percussion piston 2. Since the effective piston area of the front of the percussion piston 2 is greater than the cross-sectional area of the working chamber 22, the percussion piston 2 moves to the right in the housing 1 until the control ports 4 overlap the openings 13 and the annular groove 14. At this instant, the compressed air in the space ahead of the piston 2 expands via the annular space 10, the control ports 4, the annular groove 14, the openings 13, the longitudinal grooves 17 and the openings 15, and passes through the vent holes 6 to the atmosphere. Since from this instant onwards the pressure in the working chamber 22 is greater than the pressure in front of the piston 2, the piston is driven forwards until it strikes a percussion tip of the ram borer and then compressed air passes once again via the control ports 4 from the working chamber 22 to the space in front of the percussion piston 2.

In the forward motion position of the control tube 16 illustrated in FIG. 1, the openings 11 in the control sleeve 9 are closed by the control tube 16, so that compressed air cannot pass through the control ports 4 and the annular space 10 to the front of the percussion piston until the control ports 4 have passed over the forward edge of the control sleeve 9.

If, as shown in FIG. 2, the control tube 16 is rotated to a second, reverse position so that the openings 11 and the control ports 21 come into register, and the longitudinal grooves 17 are simultaneously so rotated that a connection no longer exists between the openings 13 and the openings 15 in the control sleeve 9, then compressed air passes from the longitudinal bore 18 into the space ahead of the percussion piston 2 as soon as the control ports 4 reach the openings 11 in the control sleeve 9. The pressure build-up in front of the percussion piston 2 thus takes place earlier than with the control tube in the position shown in FIG. 1 so that the percussion piston 2 is braked earlier and strikes the percussion tip of the ram borer only with slight energy or does not do so at all. On the other hand, the compressed air in front of the percussion piston 2 cannot expand until the control ports 4 have travelled over the rear end of the control sleeve 9 and have reached the region of the tubular extension 7. Consequently, the piston wall 3 strikes against the ring 5 at the rear end of the casing 1 and causes the rearward travel of the ram borer.

Figure 3:
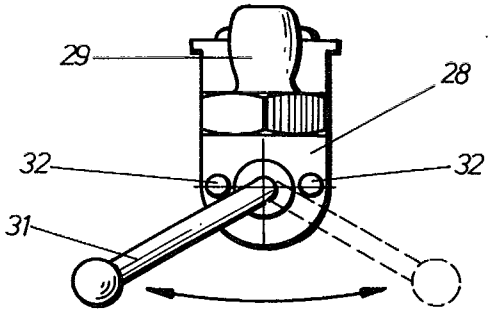
FIG. 3 is a plan of an adjusting lever of the control.
Figure 5:
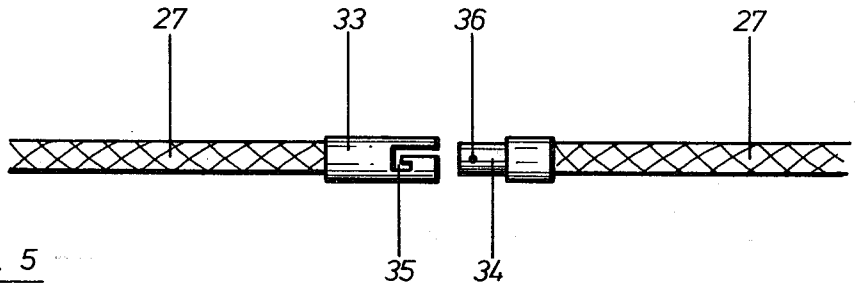
FIG. 5 is a side view of a detachable and torsionally stiff coupling between the shaft ends forming part of the control.

According to the position of the adjusting lever 31 it is clearly visible whether the ram borer will move forwards or backwards when the compressed air is supplied, since a corresponding position of the control tube 16 with respect to the control sleeve 9 is unambiguously associated with each position of the adjusting lever 31. In a central position midway between the positions of the lever illustrated in FIG. 3, the control tube is in a setting in which the ram borer stops, whereas from this setting of the lever angularly outwards, both for the forward and for the return motion, the possibility exists of infinitely adjusting the ram borer from reduced power up to full power.

The control is suitable for all types of ram borers having a percussion piston which is provided with control ports and is moved to and fro under the influence of compressed air over an axially adjustable or rotatable control sleeve or on a stationary control sleeve with an axially adjustable or rotatable control tube disposed therein. The only difference in the individual cases is the arrangement of the individual control ports. The connection for actuating the sleeve or tube is, however, always conducted out through the compressed air hose and acts either upon the movable sleeve or upon the movable control tube.

Depending upon the nature of the movement of the sleeve or tube, a tension cable or a flexible bar may be used as an actuating connection instead of the flexible, torsionally stiff shaft described above. In all these cases, the advantage arises that the actuating connection is completely protected from external influences.

I claim:

1. In a self-driven pneumatically operated ram borer, said ram borer including a tubular casing, a hose connected to said tubular casing for the supply of compressed air thereto, a percussion piston axially slidably mounted in said casing for reciprocating motion therein, means defining control ports in said piston, a control tube extending into said piston for controlling said reciprocating motion of said piston by opening and closing said control ports, means movably mounting said control tube and control means for moving said control tube between a first position in which said piston is caused to move so that it drives said borer forwards and a second position in which said piston is caused to move so that it drives said borer rearwardly, the improvement wherein said control means comprises elongate flexible actuating means extending through the inside of said hose into said casing, said flexible actuating means being coextensive with and extending within said hose to a location remote from said tubular casing, means connecting said flexible actuating means to said control tube, and said flexible actuating means being rotatable relative to said hose and having a cross-sectional area smaller than the cross-sectional area within said hose so that compressed air can flow through said hose for operating said ram borer.

2. A ram borer as claimed in claim 1, further comprising means defining a working chamber in said piston and means defining control ports in said control tube, said control tube extending into said working chamber and said means movably mounting said control tube mounting said tube for rotational movement between said first and second positions, and said flexible actuating means comprising a torsionally stiff flexible shaft extending longitudinally within said hose.

3. A ram borer as claimed in claim 2, further comprising a control sleeve having a wall, means defining control openings through said wall, and means fixedly mounting said control sleeve within said piston, said control tube being rotatably mounted within said control sleeve.

4. A ram borer as claimed in claim 2, further comprising a pipe elbow on said hose at an end thereof remote from said casing, said shaft extending through said elbow axially of said hose, an adjusting lever fixed to said shaft outside said elbow and stop means on said elbow for restricting angular movement of said adjusting lever between first and second positions corresponding to said first and second positions of said control tube.

5. A ram borer as claimed in claim 2, in which said hose comprises a plurality of lengths thereof, means detachably coupling said lengths of hose together end to end, and in which said shaft comprises a plurality of sections, each of said sections corresponding in length to one of said lengths of said hose, and torsion-transmitting detachable coupling means coupling said shaft sections together end to end.

6. A ram borer as claimed in claim 5, in which said torque-transmitting coupling means are bayonet couplings.

7. A ram borer as claimed in claim 1, further comprising a pipe elbow on said hose at an end of said hose remote from said casing, said elbow including pipe coupling means directed laterally of said hose and means defining a passage through said elbow co-axial with said hose, said flexible actuating means passing through said passage, and sealing means sealing said actuating means in said passage to prevent the escape of compressed air through said passage, but to allow movement of said actuating means in said passage.

* * * * *